US008146183B2

(12) United States Patent
Nirmel

(10) Patent No.: US 8,146,183 B2
(45) Date of Patent: Apr. 3, 2012

(54) ANCHORABLE SHEET FOR BEACH OR LAWN

(76) Inventor: Chittaranjan Narandas Nirmel, Warfordsburg, PA (US)

( * ) Notice: Subject to any disclaimer, the term of this patent is extended or adjusted under 35 U.S.C. 154(b) by 214 days.

(21) Appl. No.: 12/456,259

(22) Filed: Jun. 15, 2009

(65) Prior Publication Data

US 2010/0313354 A1 Dec. 16, 2010

(51) Int. Cl.
*A47G 9/06* (2006.01)

(52) U.S. Cl. ..... 5/417; 135/118

(58) Field of Classification Search ..... 5/417; 135/118; 52/4, 155; 248/508; 405/259.1
See application file for complete search history.

(56) References Cited

U.S. PATENT DOCUMENTS

| | | | | | |
|---|---|---|---|---|---|
| 2,526,902 | A * | 10/1950 | Rublee | 174/159 |
| 2,907,057 | A * | 10/1959 | Specht | 5/417 |
| 5,564,232 | A * | 10/1996 | Callaway | 5/4 |
| 5,832,672 | A * | 11/1998 | Griffiths et al. | 52/4 |
| 6,033,744 | A * | 3/2000 | Bright, Sr. | 428/15 |
| 6,226,813 | B1 * | 5/2001 | Wilburn et al. | 5/417 |
| 6,631,527 | B2 * | 10/2003 | Hyduk | 5/417 |

* cited by examiner

*Primary Examiner* — Robert G Santos
*Assistant Examiner* — Nicholas Polito

(57) ABSTRACT

A lightweight, inexpensive, compactly portable, readily recognized sheet is easily located securely to ground at a sandy beach or a lawn to provide one or more users a comfortable defined resting surface. The sheet is anchored to ground with a plurality of anchors that resist inadvertent lifting even by strong wind gusts, but the anchors remain with the sheet until the user chooses to separate them, e.g., to wash the sheet.

20 Claims, 3 Drawing Sheets

ANCHORABLE SHEET FOR BEACH OR LAWN

FIELD OF THE INVENTION

This invention relates to a sheet that provides a comfortable resting surface to a user on a beach or a lawn. More particularly, it relates to an inexpensive, lightweight, compactly portable, and easy-to-wash sheet that can be quickly anchored on a beach or a lawn to provide a securely located and comfortable resting surface to a user, yet is safely, quickly and easily removable even under windy conditions.

BACKGROUND OF THE RELATED ART

People often enjoy sunshine and fresh air by resting at a beach or on a lawn on a sheet of some kind. The sheet serves to keep insects and other small pests that may be present in the underlying ground from bothering the user, and generally provides a defined comfortable surface that can be easily kept relatively free of sand, grass clippings, and other ambient irritants. Unfortunately, open spaces are subject to breeze and wind gusts that can lift and sometimes even carry the sheet away from the user's chosen arrangement—especially when the user has temporarily moved away. This is a well-known problem, for which many solutions of varying but limited effectiveness are known.

One solution is to use a fairly thick or padded sheet, with the expectation that this will be difficult for at least a moderate breeze to carry away. The inevitable associated problem is that such a sheet is bulky, heavy and uncomfortable for most users to carry for any significant distance. This is especially true where the selected beach is accessible only over difficult terrain, e.g., at the bottom of a steep cliff or across large sand dunes. There is also the risk that it might become even heavier if there is a sudden downpour of rain. A thick or heavy sheet is also inherently difficult to wash and dry.

Another solution is to place heavy objects at the corners and at intermediate points on the periphery of a lightweight sheet, to weigh it down and thus secure it against wind-caused displacement. While weights like shoes and loaded backpacks are usually available, their use as ballast tends to create an unsightly array of the user's possessions, transfers dirt from items like shoes to the sheet, and reduces the area actually available for the user to occupy comfortably. A variation of this solution is to pile on sand or place stones, whichever is available, at the corners and sides of the sheet to weigh it down. This solution is not much better than the use of one's belongings as ballast.

A need therefore exists for a quickly and easily secured, inexpensive, lightweight sheet that a user can securely locate to comfortably rest on, is equally usable on a beach or a lawn, does not blow away even in a fairly strong wind, can be comfortably carried, easily washed and dried, can be readily recognized on a busy beach, that inherently clears itself of sand and light debris even in a light breeze, and can be easily retrieved even when the user has to cope with sudden wind gusts or a rain squall. Any anchoring means employed to secure such a sheet on location must be very easy to use, effective under foreseeable conditions both at a beach and on a lawn, not likely to hurt the user in normal use, not liable to damage the sheet either during use or during washing thereof, and comprise only elements not likely to get separated from the sheet except when the user so desires, e.g., to wash the sheet in a conventional washing machine with other items that may be relatively fragile. This comprehensive need is fully met by the present invention.

SUMMARY OF THE INVENTION

The principal object of this invention is to provide a securely anchorable but easily removable sheet arrangement to provide a comfortable resting surface to one or more users on the ground at a beach or on a lawn.

This object is realized by providing: a sheet having a defined periphery, a plurality of anchor-engaging elements connected to the sheet at selected anchor locations on the periphery, and a plurality of anchors that are formed to engage and disengage with respective anchor-engaging elements under user-applied force and are also formed to be forcibly driven into the ground to securely anchor the sheet thereto.

A further object is to ensure that the sheet stays securely anchored to the ground even when subjected to disturbing forces, e.g., wind gusts, once it has been located by a user.

This object is realized by providing each anchor with at least one leg and means for positively engaging the ground so as to resist withdrawal of the anchors from the ground except under the user's control.

The sheet itself can provide numerous other benefits to a user, as is described below. Other related objects and benefits will become apparent to a reader from the following detailed disclosure.

BRIEF DESCRIPTION OF THE PREFERRED EMBODIMENTS

Figure 1:
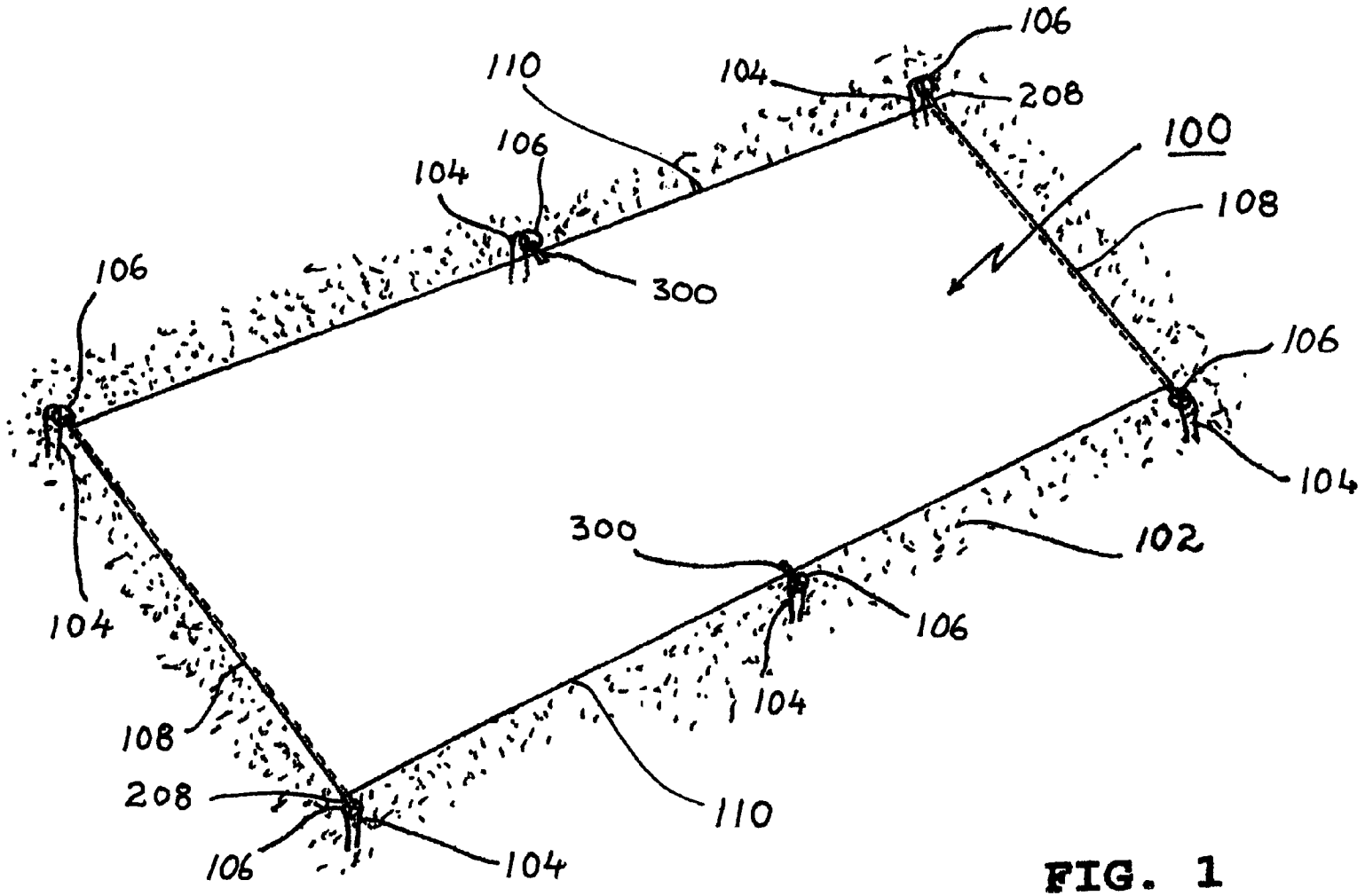
FIG. 1 is a perspective view of a sheet according to a preferred embodiment of the invention, as disposed for use on a sandy beach.

As best seen in FIG. 1, a suitable shape for the sheet 100 (shown disposed for use on a sandy beach 102) is that of a rectangle. For a single/individual user, a convenient size would be about 5 ft. by 9 ft.; for a couple a more suitable size of the sheet would be about 6 ft. by 10 ft.; and for a family or group comprising three or four persons a size of about 10 ft. by 10 ft. may suffice. As explained below, cooperating users can easily place two or more smaller sheets, with edge-to-edge disposition and shared anchor elements, to create a larger composite surface.

Other shapes may be considered. Thus a couple with two small children might prefer to use an octagonal or circular sheet of about 9 ft. diameter for a family picnic on a lawn or at a festive occasion, e.g., at an outdoor fireworks display or concert.

Highly suitable, colorful, lightweight but very durable nylon, acrylic or polyester fabrics, are sold in the U.S. at most fabric vendors and stores at very reasonable prices, e.g., $1.00 to $1.50 per yard, in widths of about 5 ft. and in bolt-lengths of many yards. Such fabrics are manufactured so that their longer sides do not easily fray in normal use. However, when a chosen length is cut off from a much longer piece most fabrics will easily fray at the transverse cut edges—hence such edges should be neatly hemmed.

Exemplary sheet 100, as best seen in FIG. 1, is shaped as a rectangle having finished short sides 108, 108 of about 5 ft. and long sides 110, 110 of about 9 ft. Such a sheet is satisfactorily anchored in place by four anchors 104, 104, 104, 104 (as more fully described below) at its respective corners, plus two more anchors 104, 104 located at about the midpoints of the longer sides. The anchors preferably are all identical, as this frees the user from having to pick and choose among them for any particular anchoring location. Suitable anchors are described below.

At each of the anchoring locations there is provided an anchor-engaging element 106, also preferably of identical structure. As best seen in FIGS. 2, 3, 4A and 4B, a very simple form for element 106 is that of a smoothly circular ring having an outer diameter "D" and an inner diameter "d" and a circular cross-section of thickness "t" equal to half the difference between the outer and inner diameters. Therefore, per FIG. 4B, $$t=(D-d)/2$$

Suitable dimensions for such an element 106, if it is made of a strong plastics material such as nylon, are approximately as follows:

D=0.75 in. and d=0.60 in., so that t=0.075 in.

Other dimensions may be chosen as best suited to particular conditions of use.

A ring having some other cross-sectional shape would probably work satisfactorily, provided its smallest cross-sectional dimension is made not less than "t".

Quite obviously, other materials, e.g., metal, composites, and the like may be acceptable, but the use of a strong material like nylon is recommended because it is light in weight, inexpensive, and easily manufactured. Also, it will not harm other clothes or make unpleasant noise by banging around when sheet 100 is washed/dried in a conventional washing machine/dryer at home. Nylon will also last a long time under exposure to ultraviolet rays in strong sunlight, and it will not rust or corrode like a metal.

Figure 2:
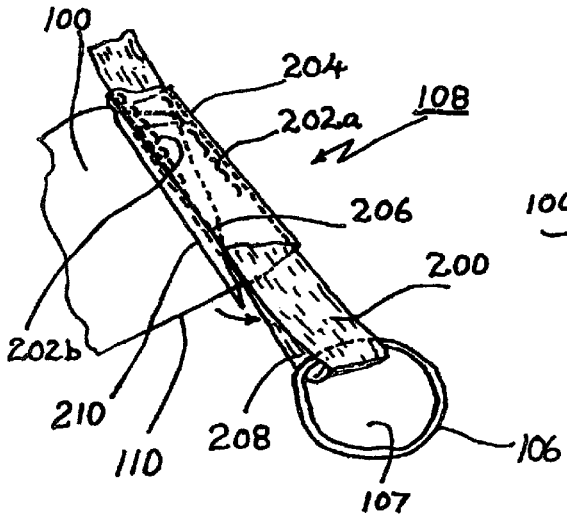
FIG. 2 is an enlarged, partially assembled, perspective view of a corner portion of the sheet to clarify preferred structure for locating an anchor-engaging element thereat.

As best understood with reference to FIG. 2, it helps to strengthen each of the short sides 108, 108 by folding the fabric over to surround a length of a strong flexible ribbon 200 and apply at least one line of strong stitching such as 202*a* and 202*b* to secure the hem so defined. A fold 204 is first made to take the fabric end over the ribbon, and a second fold 206 is then made over and then under the opposite edge of ribbon 200 to enclose it in the fabric along its entire width. At each end, ribbon 200 is passed through aperture 107 of an anchor engaging element 106, and a short length of the ribbon at its end is folded over and included beneath the parent length of ribbon 200 before the stitching is applied. This results in anchor-engaging element 106 being secured to the corner of sheet 100 via a loop 208 that preferably extends about half an inch outboard of long edge 110, with the extreme end/edge 210 of the sheet kept safe from any tendency to fray. A single line of stitching may suffice for a ribbon 200 up to ⅓ in. in width, but two parallel lines of stitching is recommended for wider ribbon.

Figure 3:
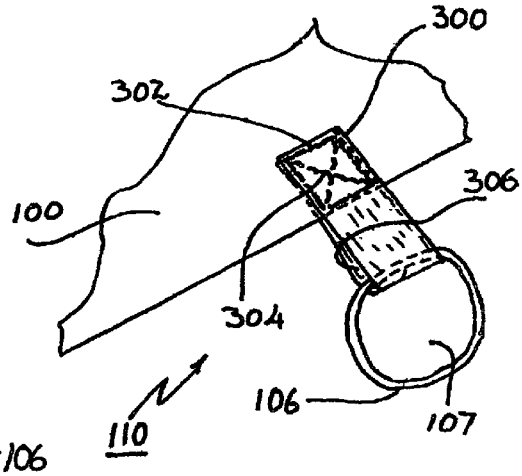
FIG. 3 is an enlarged perspective view of a mid-side portion of the sheet, to clarify details of the anchor-engaging structure thereat.
Figure 4A:
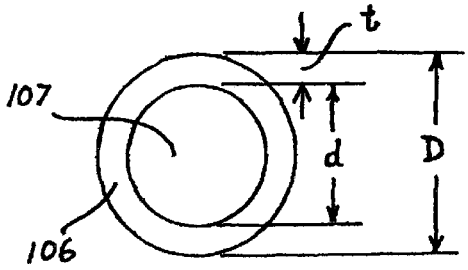
FIGS. 4A and 4B are plan and side elevation views, respectively, of an anchor-engaging ring attachable to the sheet.

As best seen in FIG. 3, a somewhat different arrangement is more suitable at other anchor locations, e.g., at about the midpoint of longer side 110 of sheet 100. The simplest structure here comprises a relatively short length of ribbon 300 (about 2-3 in.) that passes through aperture. 107 of an anchor-engaging element 106 and is folded over evenly and at right angle to side 110 to sandwich sheet 100. Strong stitching may then be applied, generally as indicated in a peripheral pattern 302 and diagonally at 304, to secure the connection between ribbon 300 and sheet 100. The length of ribbon 300 should be sufficient to ensure a strong connection to sheet 100 and such that a loop 306 of about the same length as loop 208 (preferably about ½ in.) extends outboard of side 110.

If a shape other than a rectangle or square is chosen it may be sufficient to employ anchor connection structures like the one shown in FIG. 3 at peripheral locations on the sheet separated by not more than about 4-5 ft. from each other. Edge hemming, with ribbon if appropriate, may be employed to ensure against fraying of the fabric. To create larger sheets or other shapes it may be necessary to stitch together more than one width of fabric as appropriate.

Figure 5A:
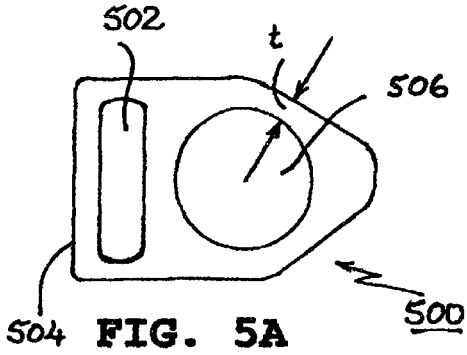
FIGS. 5A and 5B are plan and side elevation views, respectively, of an anchor-engaging alternative tab attachable to the sheet.
Figure 4B:
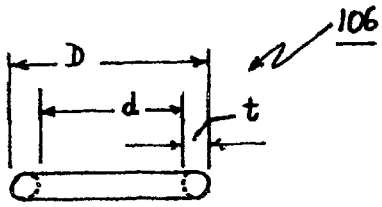

FIG. 5A illustrates an alternative form 500 for the anchor-engaging element. This form is considered more suitable for use with a wider ribbon. i.e., one more than about ½ in. wide, as might be suitable for use with relatively large sheets 100. It includes an elongate aperture 502, preferably oriented transversely and parallel to a first rectangular end 504, provided to receive the ribbon. It also includes a circular aperture 506 sized to comfortably accommodate a leg of each of at least two of the anchors described below, e.g., about 0.6 in. The other end may be shaped as desired, with the proviso that aperture 506 be defined within a rim that is nowhere less than the dimension "t" that was described earlier. The thickness "T" preferably should be about the same as "t", i.e., about 0.075 in. Anchor-engaging element 500 may be made of a metal or composite, but nylon is preferred as it provides various advantages as discussed above.

Figure 6:
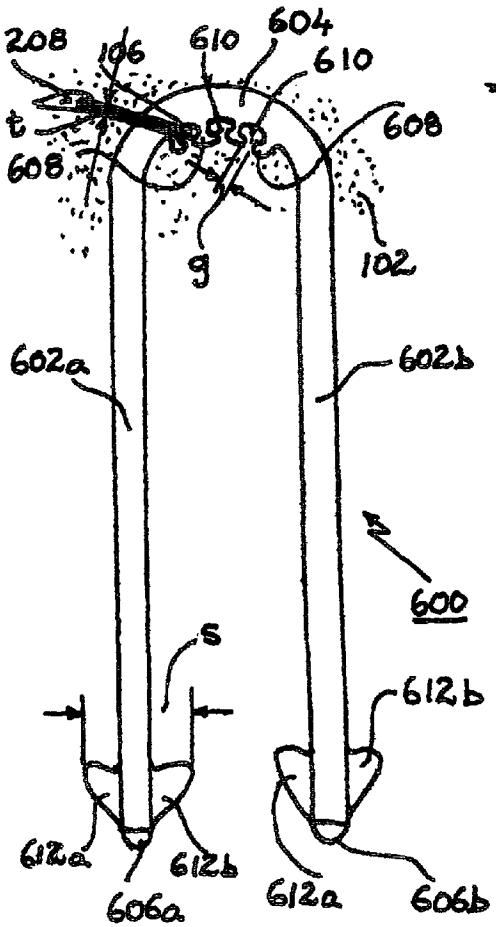

FIG. 6 illustrates certain important features of an exemplary anchor 600, preferably made of a strong, stiff but somewhat flexible, inexpensive plastics material. A suitable type of plastic material that can be easily molded with known manufacturing techniques would be like that used to make plastic clothes hangers, although nylon, metal or composites may also be used. The main body of anchor 600 comprises a bent-rod-like structure having two substantially cylindrical, parallel legs 602*a*, 602*b* contiguous with each other via a curved top portion 604. The cross-sectional diameter of this part of the structure is preferably about 0.25-0.35 in., especially if it is made of a plastics material. The straight lengths of the legs 602*a*, 602*b* are preferably in the range about 3.5-6.5 in. A suitable separation for the legs is approximately 1.0-1.5 in. The distal ends of the legs may end in smoothly rounded points 606*a*, 606*b* for easy insertion into underlying ground. Rounded ends are also less likely to hurt the user, the sheet or other fabrics.

Within the curved top portion 604 of anchor 600, which does not have to be truly circular, are provided at least two adjacently located and inwardly oriented bulbous-headed extensions 608, 608 that in profile may look like mushrooms with rounded heads. A gap "g" slightly smaller than "t" is defined at the closest approach between the heads of each adjacent pair of extensions 608, leading into a space 610 defined between them. Each space 610 has a smoothly rounded profile and lateral dimensions that are preferably at least twice as large as "g", "t" or "T", i.e., certainly large enough to accommodate comfortably at least one (and preferably two) of anchor-engaging elements such as 106, 500 or the like. By providing more than two extensions 608 one can provide a correspondingly larger number of spaces 610. This will facilitate a given anchor being usable to simultaneously engage with more than one anchor-engaging element to hold two sheets adjacent to each other.

These dimensional relationships serve an important purpose. Because gap size "g" is slightly smaller than the thickness "t" of the anchor-engaging element, and because anchor 600 is made of a somewhat flexible material, an anchor-engaging element of thickness "t" can be forced by the user into space 610 past the adjacent heads of extensions 608 defining the gap "g" between them by flexing them a little to open the gap temporarily. The force required to do this need not be substantial, but it must not be so insubstantial that the anchor-engaging element 106 or 500 can easily escape from space 610. This feature ensures against any of the anchor-engaging elements inadvertently separating from their anchors if the sheet has been lifted away from the ground either by the user or by an unusually strong gust of wind.

Fig. 6 also shows an alternative structure that by itself, i.e., independently of the gaps 610 defined between adjacent extensions 608, can help retain anchor-engaging elements to the corresponding anchors until the user decides to separate them. This is accomplished by providing at least two barb-like extensions 612*a*, 612*b* located preferably just inboard of ends 606*a*, 606*b*, dimensioned as shown to have a maximum span of "s" that is slightly larger than "d". Since the material of the anchor-engaging elements 106 or 500 is somewhat flexible, the user can easily force such an anchor-engaging element past the barbs 612*a* and 612*b*, but inadvertent separation of the anchor from each corresponding anchor-engaging element is defeated. This benefit will be realized even if the anchors are made of a very stiff metal or the like, so long as the anchor-engaging elements are made of a somewhat flexible material.

Figure 5B:
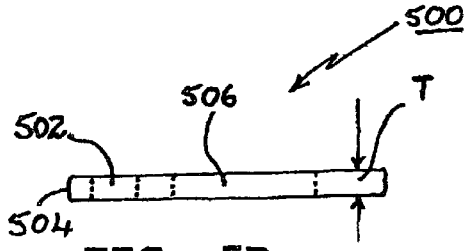

The exemplary pair of barbs 612*a*, 612*b*, oriented as shown in FIG. 5, provide an additional benefit: they are not a serious impediment to a user driving them into sand on a beach or into ground in a lawn, but once the anchor is located the barbs will positively engage with the ground, i.e., be held in the ground by more than mere friction with the sand or soil, so that it becomes difficult for a user or wind generated lifting force acting on sheet 100 to dislocate it.

Figure 7:
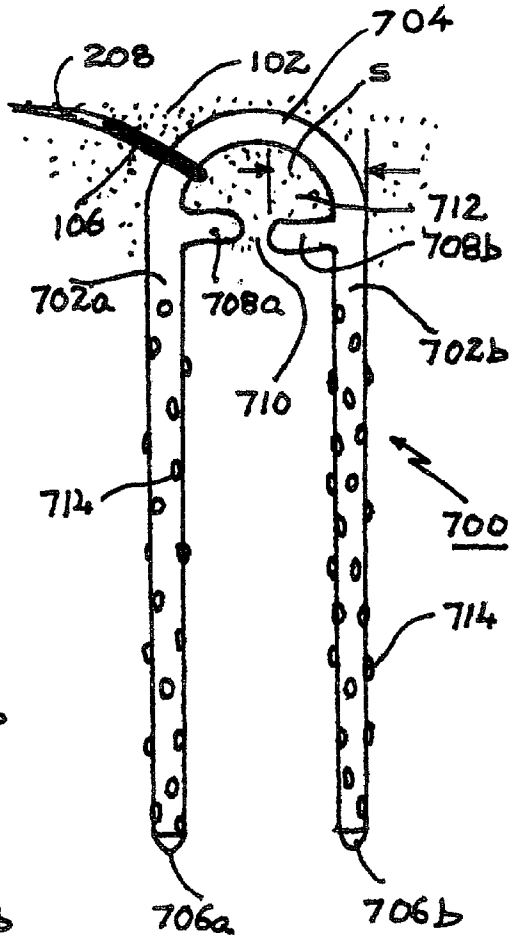

FIG. 7 shows an alternative form of anchor 700, having a body that has a pair of substantially parallel straight legs 702*a*, 702*b* contiguous with a curved portion 704. In this embodiment of the anchor, the legs have distal ends with rounded points 706*a*, 706*b*. Also provided are two inwardly oriented arms 708*a*, 708*b*, attached to the legs close to their junctions with curved portion 704 and defining a gap 710 between them. Gap 710 is larger than "t", so that the anchor-engaging elements 106 or 500 can easily pass through into space 712 as shown. Each arm 708*a*, 708*b* is sized so that its dimension "s" is slightly larger than internal diameter "d" of the anchor-engaging elements 106 or 500. This ensures that while a user can force an anchor-engaging element past either arm into space 712, the reverse cannot occur inadvertently, i.e., each such anchor-engaging element will tend to be retained loosely within space 712 if the sheet is lifted off the ground by either the user or a strong wind gust. Space 712 is obviously large enough to simultaneously accommodate more than one anchor-engaging element at a time.

Anchor 700 is also shown as having a plurality of small protuberances 714 that are distributed over the leg surfaces to improve the holding action of the sand or soil into which the legs 702*a*, 702*b* are driven to secure sheet 100. Protuberances 714 need not be all of the same size, and they do not all have to be distributed in any particular pattern.

Figure 8:
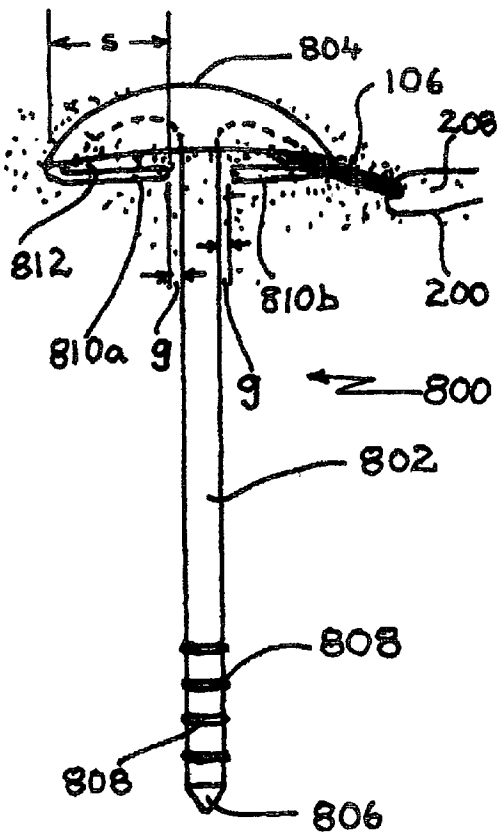
FIGS. 6, 7 and 8 are respective side elevation views of three exemplary anchors suitable for engaging the sheet to hold it securely in place at a selected location in relation to the ground below.

FIG. 8 shows yet another embodiment 800 of a suitable anchor element. It has a single rod-like central leg 802 contiguous with an inverted-bowl-like head 804. Leg 802 ends in a rounded point 806, and may also be provided with a plurality of protruding rings 808 that serve the same purpose as protuberances 714 in the previous embodiment, i.e., they make it difficult for anchor 800 to be inadvertently pulled out of the ground, e.g., under wind action. It is considered better to provide such rings then to form grooves into the thickness of leg 800 to avoid weakening the leg.

Under the head 804 and attached to its periphery are provided a pair of arms 810*a*, 810*b* that are spaced below the head rim far enough to form a gap "g" slightly smaller than "t" to allow forced passage via the gap of anchor-engaging element 106 or 500. (See FIG. 8.) The overall length of each arm 810*a*, 810*b* is "s", i.e., slightly larger than the inner diameter "d" of anchor-engaging element 106 or of aperture 506 in alternative element 500. This will ensure that while the user can easily force an anchor-engaging element into engagement with anchor 800 an inadvertent separation is made difficult.

As will be readily appreciated by persons skilled in the mechanical arts, many of the features discussed above are fungible, e.g., barbs 612*a*, 612*b* could be employed on the single leg of anchor 800, rings 808 could replace protuberances 714, and so on.

In practice, a user need only unfold sheet 100, forcibly engage the selected anchors to the various anchor-engaging elements, push the anchors one at a time into the ground, and then step, even barefoot, on the top of each anchor to forcibly drive it into the underlying ground to the level of the sheet or even just below that level. Experiments show that it is most convenient to start with the anchor at one of the corners that is upwind relative to the body of the sheet 100. This should be followed by the other corners in logical sequence, with each side sequentially stretched out as appropriate, and the anchoring process finished by then similarly locating the anchors at the mid-point of the longer sides.

The result should be that the sheet is fully stretched out flat to the ground according to its shape, and the uppermost ends of all the anchors are at or just below the level of the sheet, i.e., none is sticking out of the ground. This should seriously reduce the likelihood that any user or visitor will trip over either an anchor or the edge of the sheet. Even with the sheet laid flat to the ground, particularly when it is unoccupied by the user, wind passing over the sheet will occasionally cause gentle flapping of the sheet in situ and this action will facilitate the blowing away of any sand or ambient light debris, e.g., grass clippings from a lawn, that may have landed on the sheet. The sheet is thus automatically cleaned by the wind.

To remove the sheet the user should preferably start by pushing a finger under the head part of the anchor that is most downwind of the sheet, wiggle it a little in place to free it, and then lift it upward out of the ground. This should be repeated with the other anchors, moving in the upwind direction. This sequential order has been found to limit any tendency of the sheet to flap around as it is being gathered up—especially when the wind is strong. While this is happening, the various anchors will remain connected loosely to their respective anchor-engaging elements. The user may then fold the sheet, but need not separate the anchors from the sheet to store the assembly pending another use. Before washing the sheet, the user need only force each anchor to separate from its respective anchor-engaging element—which should be a very easy exercise.

Prototypes with polyester fiber sheets about 5 ft. by 10 ft. in size, provided with plastic anchors, have been found to weigh only about 1.5 lbs., and the firmly folded sheet and six anchors can easily be slipped into a small cloth bag or even a short sock to keep it compactly stored. This aspect of the invention makes it particularly suitable for hikers, backpackers, bicyclists and older persons who logically prefer not to carry unnecessary weight or volume but wish to enjoy being able to stretch out comfortably on a beach or at a campground, e.g., to sunbathe. As noted earlier, if such a sheet becomes wet, e.g., due to a sudden downpour, there will be no significant increase in its weight and it can be dried easily.

This modest invention comprising a colorful lightweight sheet and anchors can serve the owner/user in other important ways. Note that by employing two anchors at each of the anchoring locations along one side of a rectangular sheet, and then supporting the opposite side, e.g., with appropriately sized sticks or the like, a user could obtain additional use by creating some protection against strong sun and/or wind. This may be of great benefit for someone who happens to be out in the desert and needs to stop and rest but has no other means for obtaining shade during a very hot day or is caught in a dust storm. A sheet made of tightly woven polyester fiber will also provide a camper highly effective protection against mosquitoes. In an emergency, in an out of the way location, the brightly colored sheet could help aerial rescuers to visually locate a user who happens to have it available and so can spread it out even in windy conditions.

This invention is limited solely by the claims appended below, and obvious modifications of the disclosed embodiments are considered comprehended therein.

The invention claimed is:

1. A securely anchorable but easily removable sheet arrangement to provide a comfortable resting surface to a user on the ground, comprising:

a sheet having a defined periphery; a plurality of stiff anchor-engaging elements;

a plurality of flexible connecting elements, connected to the sheet at selected anchor locations on the periphery folded over and looped through respective anchor-engaging elements to flexibly connect the same to the sheet; and a plurality of anchors, formed to selectively engage through and disengage from respective anchor-engaging elements under user-applied force and also formed to be forcibly driven into the ground so that the uppermost ends of the anchors are at or below the level of the sheet while securely anchoring the sheet thereat.

2. The sheet arrangement according to claim 1, wherein:

the sheet and the flexible elements each comprise a respective material selected from a group of materials consisting of nylon, polyester, acrylic, cotton and blends thereof.

3. The sheet arrangement according to claim 1, wherein:

the anchor-engaging elements comprise a strong but flexible material selected from a group of materials consisting of plastics, metals and composites.

4. The sheet arrangement according to claim 1, wherein:

the anchors comprise a strong and stiff but flexible plastics material.

5. The sheet arrangement according to claim 1, wherein:

the anchor-engaging elements comprise rings flexibly connected to the sheet at respective anchor locations, each ring having a minimum cross-sectional thickness "t" and an aperture of inner diameter "d" sized to simultaneously accommodate said flexible connection to the sheet and to allow engagement with at least one anchor inserted through the aperture into ground during use.

6. The sheet arrangement according to claim 1, wherein:

each anchor-engaging element has a body of thickness "T", provided with first and second apertures through the thickness "T", wherein the flexible connecting elements each comprise a looped ribbon of predetermined width, wherein the first aperture is elongate and is sized to accommodate the width of the looped ribbon, and the second aperture is circular and has at least one peripheral portion with a minimum cross-sectional dimension "t" about the same as the thickness "T" and an inner diameter "d" sized to allow engagement with at least one anchor during use.

7. The sheet arrangement according to claim 1, wherein:

each anchor has a body comprising at least one leg connected at an uppermost end to a head portion upon which the user can step to force the at least one leg into the ground until the uppermost end of the head portion is about level with or is slightly below the adjacent periphery of the sheet.

8. The sheet arrangement according to claim 7, wherein:

the anchor body comprises two generally parallel cylindrical straight legs contiguous with an intermediate curved portion located above the legs during use.

9. The sheet arrangement according to claim 7, wherein:

the head portion comprises a rounded cap-like top connected below to a single straight leg.

10. The sheet arrangement according to claim 7, wherein:

each anchor comprises retention means for retaining engagement with the anchor-engaging element after the anchor-engaging element is forced into such engagement by the user until the user forces disengagement.

11. The sheet arrangement according to claim 10, wherein:

said retention means comprises at least two generally barb-shaped extensions provided on opposite sides of each leg adjacent to its distal end, the extensions being sized such that a user must force the anchor-engaging element over the extensions into a space defined past them for retaining the anchor-engaging element during use.

12. The sheet arrangement according to claim 10, wherein:

said retention means comprises a plurality of round-headed extensions contiguous with and oriented downward and inward of the curved top portion, with each pair of adjacent extensions defining between them a gap of width "g" leading into a space sized to receive and comfortably accommodate at least one of the anchor-engaging elements, and wherein "g" is slightly smaller than the minimum cross-sectional dimension of the anchor-engaging element.

13. The sheet arrangement according to claim 10, wherein:

said retention means comprises a pair of inwardly oriented lateral arms formed at about the junction of the straight legs and the curved portion of the body, the arms being sized such that a user must exert a force to pass an anchor-engaging element into a space defined by the arms and the curved portion, said space being large enough to retain a plurality of anchor-engaging elements until the user forces them past the arms to disengage them from the anchor.

14. The sheet arrangement according to claim 9, wherein:

said retention means comprises a pair of lateral arms of length "s" mounted to and below a periphery of the top and extending inward toward the central leg, a distal end of each arm being disposed to be separated from the leg by a gap "g" slightly smaller than the minimum cross-sectional dimension of the anchor-engaging element around the aperture receiving the anchor, so that the anchor-engaging element can be forced by the user through the gap "g" to retain it in engagement with the anchor until the user disengages the same.

15. The sheet arrangement according to claim 7, wherein: each anchor comprises positive-engagement means for positively engaging with the ground and thereby increasing resistance to separation of the anchor from the ground.

16. The sheet arrangement according to claim 15, wherein: the positive-engagement means comprises at least two generally barb-shaped extensions provided adjacent to a distal end of each leg, the extensions cooperating to resist withdrawal of the anchor from the ground during use.

17. The sheet arrangement according to claim 15, wherein: the positive-engagement means comprises a plurality of small protuberances on the surface of each leg, the protuberances cooperating to resist withdrawal of the anchor from the ground during use.

18. The sheet arrangement according to claim 15, wherein: the positive-engagement means comprises at least one raised ring on the surface of each leg, the ring serving to resist withdrawal of the anchor from the ground during use.

19. The sheet arrangement according to claim 16, wherein: the barb-shaped extensions are sized to also serve as means for retaining the anchor to the corresponding anchor-engagement element, such that a user must force the anchor-engaging element past the barb-shaped extensions to locate the anchor-engagement element into a space defined past the barb-shaped extensions.

20. A securely anchorable but easily removable sheet arrangement to provide a comfortable resting surface to a user on the ground, comprising:

a sheet of predetermined shape and size and having a defined periphery, comprising a fabric made from a group of materials consisting of nylon, polyester, acrylic, cotton and blends thereof;

a plurality of anchor-engaging elements, flexibly connected to the sheet at selected anchor locations on the periphery; and a plurality of anchors, for engaging through respective anchor-engaging elements under user-applied force, the anchors being formed to be forcibly driven into engagement with the ground to securely hold the sheet thereat, wherein the anchor-engaging elements comprise rings made of a strong and stiff but flexible plastics material and are each flexibly connected to the sheet at respective anchor locations by a ribbon folded over and looped through a corresponding ring and comprising a material selected from a group of materials consisting of nylon, polyester, acrylic, cotton and blends thereof, each ring having a cross-sectional thickness "t" and an aperture sized to simultaneously accommodate said ribbon and allow engagement with at least one anchor during use, and each anchor has a body made of a strong and stiff but flexible plastics material and has at least one leg contiguous at its uppermost end with a head portion upon which the user can step to force the at least one leg into the ground through a corresponding ring until the head portion is about level with or is slightly below the adjacent periphery of the sheet, and comprises retention means for retaining engagement with the anchor-engaging element after the anchor-engaging element is forced into such engagement by the user until the user forces disengagement and further comprises resistance means for increasing resistance to separation of the anchor from the ground.

* * * * *